US009407023B2

(12) United States Patent
Oniki

(10) Patent No.: US 9,407,023 B2
(45) Date of Patent: Aug. 2, 2016

(54) TRANSMISSION MODULE, SHIELDING METHOD, TRANSMISSION CABLE, AND CONNECTOR

(71) Applicant: Sony Corporation, Tokyo (JP)

(72) Inventor: Kazunao Oniki, Tokyo (JP)

(73) Assignee: Sony Corporation, Tokyo (JP)

( * ) Notice: Subject to any disclaimer, the term of this patent is extended or adjusted under 35 U.S.C. 154(b) by 160 days.

(21) Appl. No.: 14/286,204

(22) Filed: May 23, 2014

(65) Prior Publication Data

US 2014/0364004 A1 Dec. 11, 2014

(30) Foreign Application Priority Data

Jun. 5, 2013 (JP) ..... 2013-118521

(51) Int. Cl.
*H01R 12/00* (2006.01)
*H01R 12/77* (2011.01)

(52) U.S. Cl.
CPC ..... *H01R 12/775* (2013.01); *Y10T 29/49204* (2015.01)

(58) Field of Classification Search
CPC ..... H01B 13/00
USPC ..... 439/497
See application file for complete search history.

(56) References Cited

U.S. PATENT DOCUMENTS 3,462,542 A * 8/1969 Richter ..... H01B 7/08 174/36
3,795,885 A * 3/1974 Desso ..... H01R 12/79 361/749
4,130,334 A * 12/1978 Anderson ..... H01R 4/64 174/78
5,727,971 A * 3/1998 Junkins ..... H01R 13/6593 439/499
5,763,830 A * 6/1998 Hsueh ..... H02G 15/085 174/261
6,602,092 B2 * 8/2003 Soubh ..... H01R 12/62 439/493
7,348,497 B2 * 3/2008 Kawauchi ..... H05K 1/182 174/260
7,442,076 B2 * 10/2008 Huang ..... H01R 13/641 439/188
7,503,112 B2 * 3/2009 Ice ..... H05K 3/3405 29/827
7,509,508 B2 * 3/2009 Chen ..... G06F 13/409 439/492
8,277,245 B2 * 10/2012 Fix ..... H02G 3/32 439/497
2006/0065432 A1 * 3/2006 Kawauchi ..... H05K 1/182 174/254
2012/0021640 A1 * 1/2012 Masuda ..... H04L 25/0272 439/502
2012/0077371 A1 * 3/2012 Fix ..... H02G 3/32 439/497
2014/0097021 A1 * 4/2014 Su ..... H05K 9/00 174/72 R
2014/0285393 A1 * 9/2014 Biglarbegian ..... H01P 5/107 343/850

FOREIGN PATENT DOCUMENTS

JP 2006-286318 10/2006

* cited by examiner

*Primary Examiner* — Abdullah Riyami
*Assistant Examiner* — Nader J Alhawamdeh
(74) *Attorney, Agent, or Firm* — K&L Gates LLP

(57) ABSTRACT

A transmission module includes a connector component including a connector side substrate having a terminal component including a ground terminal and a data terminal, and a signal processing component mounted on the connector side substrate for processing a high frequency signal having a frequency higher than that of a data signal inputted or outputted via the data terminal; and a transmission cable component for transmitting the high frequency signal including a cable side substrate having a flexibility on which a cable side ground layer electrically connected to the ground terminal and a signal line to which the high frequency signal is transmitted are formed, the cable side ground layer being disposed at least at lower and upper sides of the signal line as a part including the cable side ground layer of the cable side substrate is folded.

15 Claims, 15 Drawing Sheets

TRANSMISSION MODULE, SHIELDING METHOD, TRANSMISSION CABLE, AND CONNECTOR

CROSS REFERENCES TO RELATED APPLICATIONS

The present application claims priority to Japanese Priority Patent Application JP 2013-118521 filed in the Japan Patent Office on Jun. 5, 2013, the entire content of which is hereby incorporated by reference.

BACKGROUND

The present application relates to a transmission module, a shielding method, a transmission cable and a connector. More particularly, the present application relates to the art for suppressing electromagnetic noises generated upon a transmission of a high frequency signal including a millimeter wave.

SUMMARY

In recent years, electronic devices are getting smaller and sophisticated. Correspondingly, a transmission signal has a high frequency of from several GHz (gigaherz) to several tens GHz. When a high capacity transmission by the high frequency signal is carried out, one of big issues is to inhibit EMI (electromagnetic interference).

As a current standard, the EMI should be inhibited to not more than 5 mV/m, for example.

Japanese Patent Application Laid-open No. 2006-286318 discloses a flat cable on which a shield film is formed in order to inhibit the EMI.

For transmission of the high frequency signal, a waveguide, a substrate dielectric waveguide or the like is used. Such a waveguide is typically not flexible, is therefore low in the degree of freedom of wiring and is subject to limitation about mounting in the device.

In view of the degree of freedom, it is desirable to use the transmission cable being soft and having an excellent flexibility like the flat cable described in Japanese Patent Application Laid-open No. 2006-286318.

However, the cable described in Japanese Patent Application Laid-open No. 2006-286318 needs an additional member in order to form a layer for shielding an electromagnetic wave, which results in increased costs.

It is therefore desirable to provide a signal transmission configuration by inhibiting the EMI and ensuring the degree of freedom of wiring at low costs.

According to an embodiment of the present application, there is provided a transmission module, including:

a connector component including a connector side substrate having a terminal component including a ground terminal and a data terminal, and a signal processing component mounted on the connector side substrate for processing a high frequency signal having a frequency higher than that of a data signal inputted or outputted via the data terminal; and a transmission cable component for transmitting the high frequency signal including a cable side substrate having a flexibility on which a cable side ground layer electrically connected to the ground terminal and a signal line to which the high frequency signal is transmitted are formed, the cable side ground layer being disposed at least at lower and upper sides of the signal line as a part including the cable side ground layer of the cable side substrate is folded.

In this way, the signal line of the transmission cable component is shielded.

In the above-described transmission module according to the present application, the cable side ground layer is desirably disposed at lower, upper and lateral sides of the signal line.

In the above-described transmission module according to the present application, the cable side ground layer has desirably a shape including a plurality of cutouts.

In this way, bending stiffness of the cable side ground layer is reduced.

In the above-described transmission module according to the present application, the connector side substrate and the cable side substrate are desirably configured as an integrated substrate made of a same material.

In this way, the transmission module including the connector component and the transmission cable component are produced using the integrated flexible substrate.

In the above-described transmission module according to the present application, a connector side ground layer electrically connected to the ground terminal is formed on the connector side substrate, and the connector side ground layer is desirably disposed at least at lower and upper sides of an area where electromagnetic noises are generated due to the high frequency signal as a part including the connector side ground layer of the connector side substrate is folded.

In this way, shielding effectiveness can be provided for the electromagnetic noises generated due to the high frequency signal not only at the transmission cable component but also at the connector component.

In the above-described transmission module according to the present application, the signal processing component is desirably an RF chip, and the connector side ground layer is desirably disposed at least at lower and upper sides of the RF chip as a part including the connector side ground layer of the connector side substrate is folded.

This enables that electromagnetic noises generated in the RF chip are shielded.

In the above-described transmission module according to the present application, a carrier wave of a signal transmitted via the transmission cable is desirably a millimeter wave.

This enables that electromagnetic noises generated upon a transmission of a high frequency signal within a millimeter wave band are shielded.

In the above-described transmission module according to the present application, the cable side substrate or the connector side substrate is configured of LCP.

In this way, the cable side substrate or the connector side substrate are configured of the material that efficiently suppresses noises.

According to an embodiment of the present application, there is provided a method of shielding a signal line in the transmission module including a connector component including a connector side substrate having a terminal component including a ground terminal and a data terminal, and a signal processing component mounted on the connector side substrate for processing a high frequency signal having a frequency higher than that of a data signal inputted or outputted via the data terminal; and a transmission cable component for transmitting the high frequency signal including a cable side substrate having a flexibility on which a cable side ground layer electrically connected to the ground terminal and the signal line to which the high frequency signal is transmitted are formed, including:

folding a part including the cable side ground layer of the cable side substrate, and disposing the cable side ground layer at least at lower and upper sides of the signal line.

In the above-described method of shielding a signal line transmission module according to the present application, the signal line of the transmission cable component is shielded as in the transmission module according to the present application.

According to an embodiment of the present application, there is provided a transmission cable, including a substrate having a flexibility on which a ground layer and a signal line are formed, the ground layer being disposed at least at lower and upper sides of the signal line as a part including the ground layer of the substrate is folded.

In the above-described transmission cable according to the present application, the signal line of the transmission cable component is shielded as in the transmission module according to the present application.

According to an embodiment of the present application, there is provided a connector, including:

a substrate having a flexibility on which a terminal component including a ground terminal and a data terminal, and a ground layer electrically connected to the ground terminal are formed; and a signal processing component mounted on the substrate for processing a high frequency signal having a frequency higher than that of a data signal inputted or outputted via the data terminal, the ground layer being disposed at least at lower and upper sides of an area where electromagnetic noises are generated due to the high frequency signal as a part including the ground layer of the substrate is folded.

This enables that electromagnetic noises generated due to a high frequency signal in the connector are shielded.

These and other objects, features and advantages of the present application will become more apparent in light of the following detailed description of best mode embodiments thereof, as illustrated in the accompanying drawings.

Additional features and advantages are described herein, and will be apparent from the following Detailed Description and the figures.

DETAILED DESCRIPTION

Hereinafter, embodiments of the present application will be described.

The embodiments of the present application will be described in the following order.

<1. First Embodiment>

[1-1. Configuration of Transmission Module]

[1-2. Production Method]

[1-3. Summary of First Embodiment]

<2. Second Embodiment>

[2-1. Configuration of Transmission Module and Production Method]

[2-2. Summary of Second Embodiment]

<3. Alternative Embodiment>

<4. Present application>

1. First Embodiment

1-1. Configuration of Transmission Module

Hereinafter, embodiments of the present application will be described with reference to the drawings.

Figure 1:
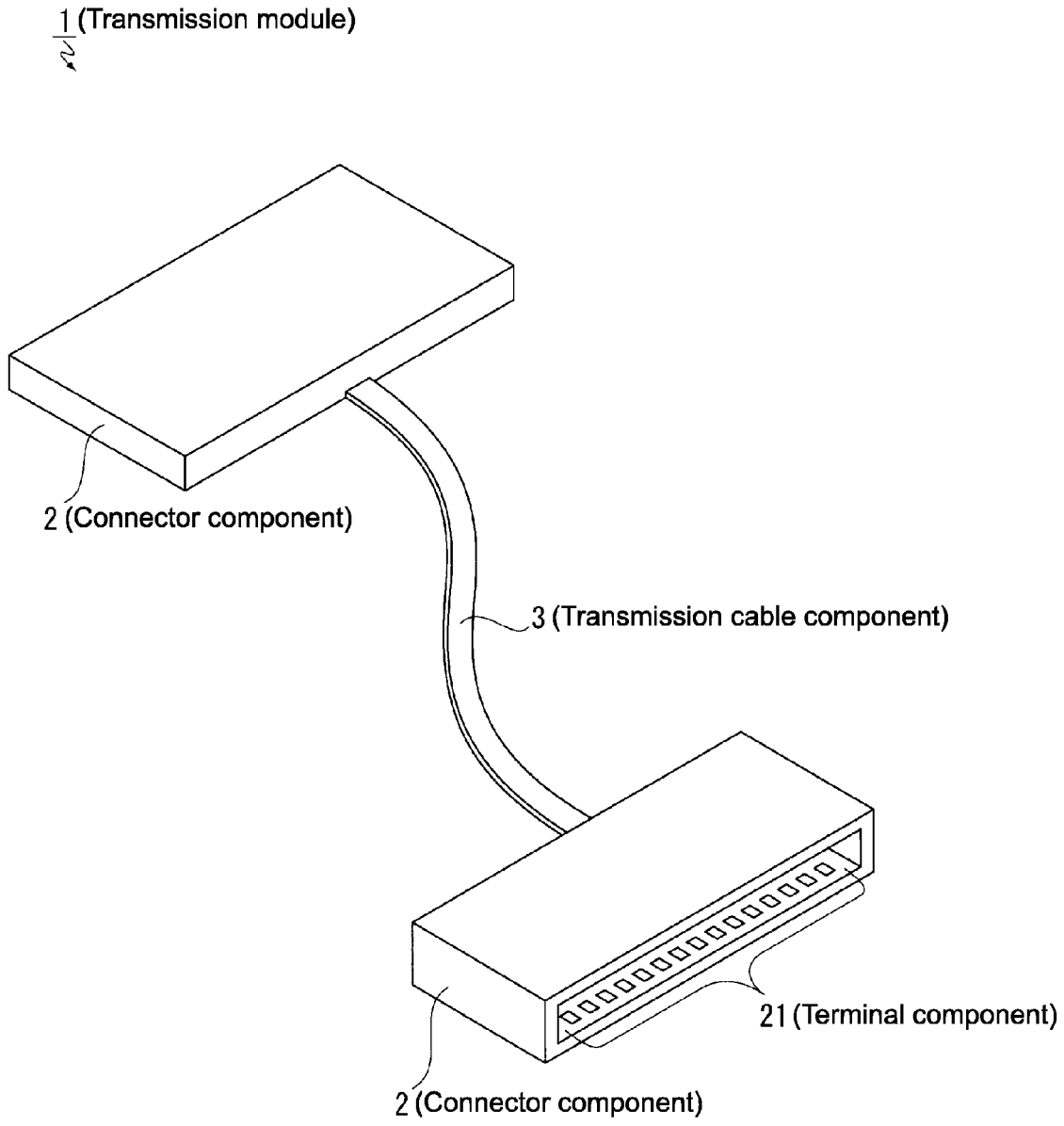
FIG. 1 is a schematic appearance perspective view of a transmission module according to a first embodiment.
Figure 2:
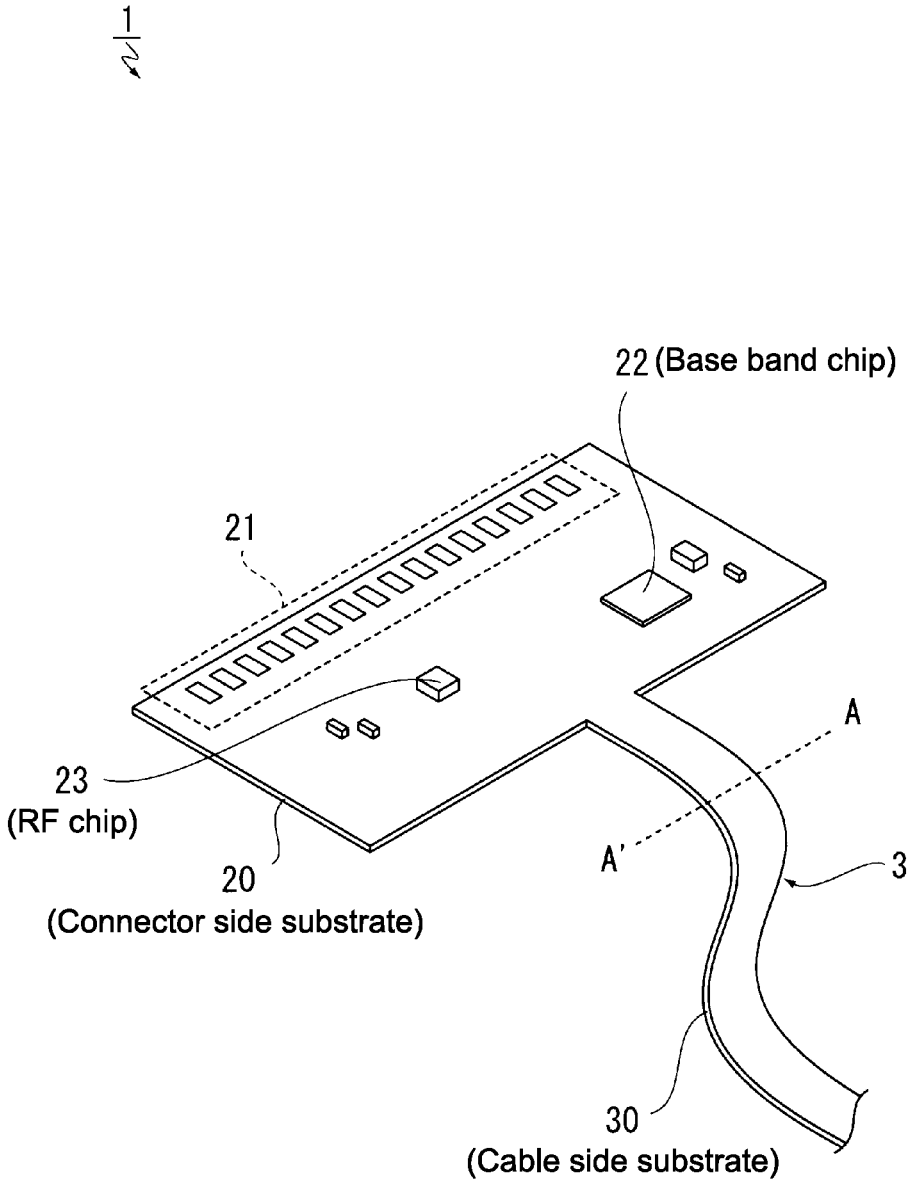
FIG. 2 is a schematic perspective view showing a configuration of a connector side substrate and a cable side substrate included in the transmission module.
Figure 3:
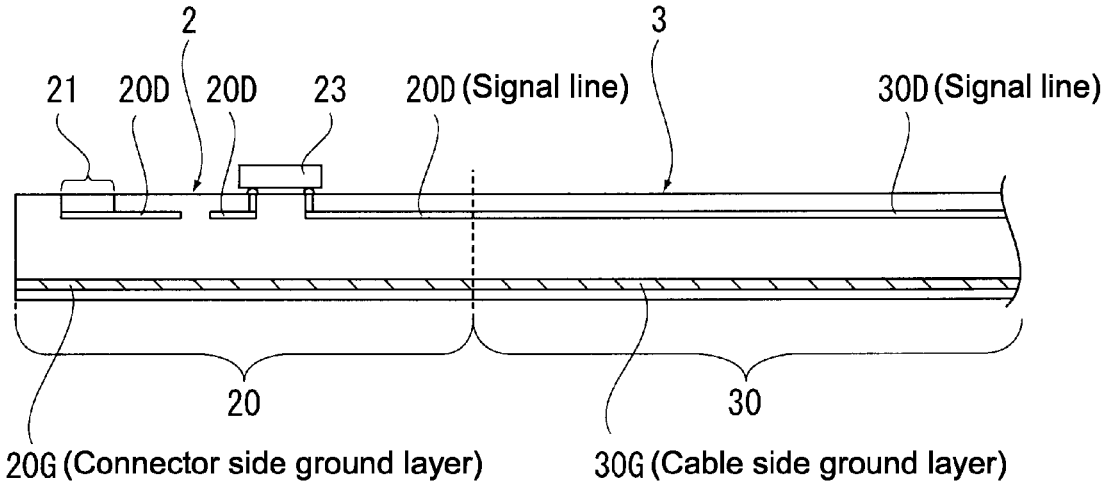
FIG. 3 is a schematic longitudinal cross-sectional view for illustrating the connector side substrate and the cable side substrate.
Figure 4A:
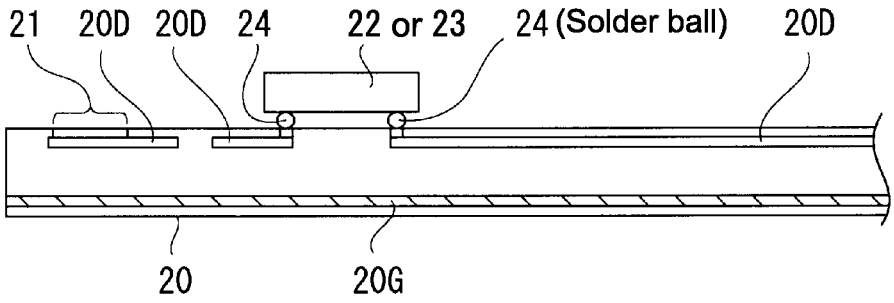
FIGS. 4A and 4B are each a schematic longitudinal cross-sectional view for illustrating a method of mounting a chip on the connector side substrate.
Figure 4B:
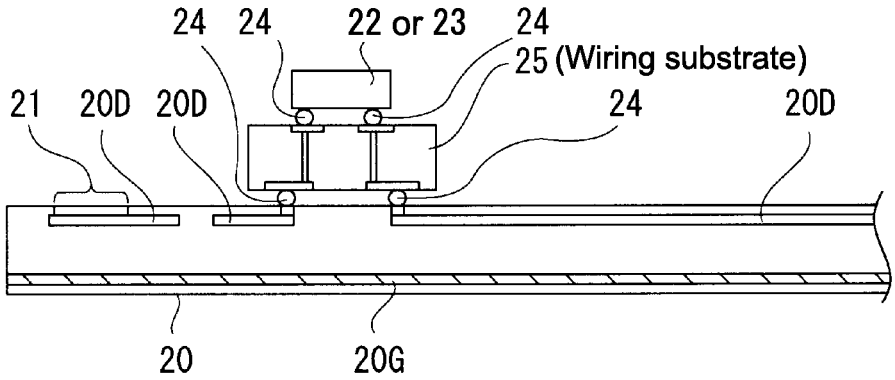
Figure 5:
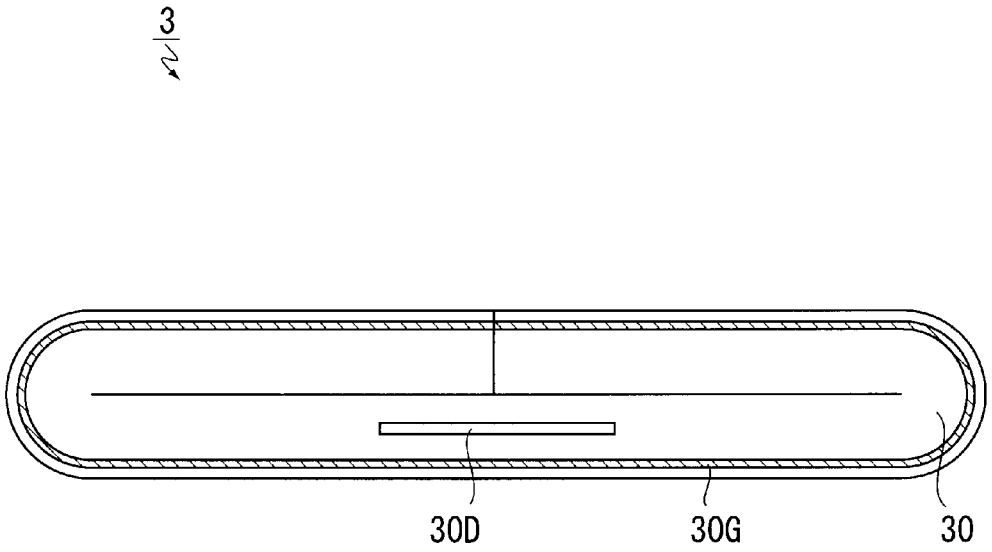
FIG. 5 is a schematic cross-sectional view of a transmission cable component included in the transmission cable along an A-A' cross-section shown in FIG. 2.

FIGS. 1 to 5 are views for illustrating a configuration of a transmission module 1 according to a first embodiment of the present application. FIG. 1 is a schematic appearance perspective view of the transmission module 1. FIG. 2 is a schematic perspective view showing a configuration of a connector side substrate 20 and a cable side substrate 30 included in the transmission module 1. FIG. 3 is a schematic longitudinal cross-sectional view for illustrating cross-sectional structures of the connector side substrate 20 and the cable side substrate 30. FIGS. 4A and 4B are each a schematic longitudinal cross-sectional view for illustrating a method of mounting a chip on the connector side substrate 20. FIG. 5 is a schematic cross-sectional view of a transmission cable component 3 included in the transmission cable 1 along an A-A' cross-section shown in FIG. 2.

FIG. 3 shows both the cross-sectional structure of the connector side substrate 20 and the cross-sectional structure of the cable side substrate 30 separated by a vertical broken line.

The transmission module 1 in the first embodiment is mounted within a predetermined electronic device and is used for transmitting a signal within the device, for example.

The transmission module 1 includes connector components 2, 2 and the transmission cable component 3 connecting the connector components 2, 2 (see FIG. 1). The connector components 2, 2 have terminal components 21. Predetermined terminals are formed in the terminal components 21, 21. The terminals are connected to terminals of predetermined connectors within the electronic device. This allows a signal to be transmitted via the transmission module 1.

The connector components 2, 2 have the same configuration. In the following, only one of the connector components 2, 2 will be described.

The connector component 2 has the connector side substrate 20, and the transmission cable component 3 has the cable side substrate 30 (see FIG. 2). Although the details are described later, in the present embodiment, the connector side substrate 20 and the cable side substrate 30 are configured as an integrated substrate made of the same material. The integrated substrate including the connector side substrate 20 and the cable side substrate 30 is configured as a flexible substrate 10 having a flexibility. In this embodiment, an LCP (liquid crystal polymer) is used for the flexible substrate 10.

The terminal component 21 included in the connector side substrate 20 has a data terminal to or from which a data signal at least to be transmitted is inputted or outputted, and a ground terminal (either of which are not shown).

On the connector side substrate 20, a variety of electronic components such as a semiconductor chip, a resistive element and a capacitor that are necessary for a signal transmission are mounted. Specifically, a base band chip 22 and an RF (radio frequency) chip 23 are mounted as semiconductor chips on the connector side substrate 20 according to the present embodiment. The semiconductor chips are necessary for the signal transmission in accordance with the predetermined communication standard.

The base band chip 22 is electrically connected to the data terminal disposed at the terminal component 21, and allows the data signal inputted via the data terminal to be inputted. The base band chip 22 converts (encodes) the data signal to be inputted via the data terminal into a signal having a predetermined format (a communication signal) in accordance with the communication standard.

The RF chip 23 is electrically connected to the base band chip 22, frequency-converts the communication signal inputted from the base band chip 22, and generates a transmission signal having a frequency higher than that of the data signal. In the present embodiment, the transmission signal has a relatively high frequency as the carrier wave is a millimeter wave of about 30 GHz (gigahertz) to 300 GHz. The transmission signal is transmitted via the transmission cable component 3 to the other connector component 2 side.

In the connector component 2 that is a receiving side where the transmission signal is inputted via the transmission cable component 3, the RF chip 23 frequency-converts the transmission signal of interest to generate a communication signal. The base band chip 22 disposed on the connector component 2 at the receiving side decodes the communication signal to be inputted from the RF chip 23 and demodulates them into the data signal. The data signal demodulated is fed into the data terminal in the terminal component 21.

As shown in the cross-sectional view of FIG. 3, signal lines 20D and a connector side ground layer 20G are formed inside of the connector side substrate 20, and a signal line 30D and a cable side ground layer 30G are formed inside of the cable side substrate 30.

Although not shown, the connector side ground layer 20G is electrically connected to the ground terminal in the terminal components 21. Also, the cable side ground layer 30G is electrically connected to the connector side ground layer 20G and is also thereby electrically connected to the ground terminal. In this embodiment, as the connector side substrate 20 and the cable side substrate 30 are integrated, the connector side ground layer 20G and the cable side ground layer 30G are also integrally formed.

The signal lines 20D electrically connected to an RF chip 23 are electrically connected to the signal line 30D formed in the cable side substrate 30. Also, the connector side ground 20G and the cable side ground layer 30G are electrically connected.

In this way, it is possible to transmit a signal from the RF chip 23 via the transmission cable component 3 and a signal to the RF chip 23 via the transmission cable component 3, as described above.

FIG. 3 is only a schematic view, and multilayered signal lines 20D are actually formed in the connector side substrate 20. Specifically, conductor layers including the signal lines 20D patterned in predetermined shapes are laminated via insulating layers. The conductor layers (the signal lines 20D) separated from the insulating layers by vias extending in a thickness direction of the substrate are electrically connected.

Here, semiconductor chips including the base band chip 22 and the RF chip 23 are mounted on the connector side substrate 20 by a flip chip bonding, as shown in FIG. 4A. Specifically, electrodes formed on the connector side substrate 20 are connected to electrodes formed on the semiconductor chip including the base band chip 22 and the RF chip 23 via a plurality of solder balls 24, 24, . . . .

Although the electrodes formed on the connector side substrate 20 are directly connected to the electrodes formed on the semiconductor chip including the base band chip 22 and the RF chip 23 via the solder balls 24, 24, . . . in FIG. 4A, they may be alternatively connected via a wiring substrate (an interposer) 25, as shown in FIG. 4B. In this case, the electrodes formed on the connector side substrate 20 are connected to lower electrodes of the wiring substrate 25 via the solder balls 24, 24, . . . , and the electrodes formed on the semiconductor chip including the base band chip 22 and the RF chip 23 are connected to upper electrodes of the wiring substrate 25 via the solder balls 24, 24, . . . .

By connecting via the wiring substrate 25, the number of layers included in the connector side substrate 20 can be decreased.

When the high frequency signal within a millimeter wave band is transmitted according to this embodiment, it is desirable that EMI (electromagnetic interference) be inhibited in the transmission cable component 3.

Therefore, in this embodiment, the transmission cable component 3 has a structure that the signal line 30D is entirely surrounded by the cable side ground layer 30G, as shown in a cross-sectional view of FIG. 5. Specifically, both sides of the cable side substrate 30 are folded to cover the signal line 30D with the cable side ground layer 30G.

1-2. Production Method

Referring to FIGS. 6 to 8, a method of producing the shield structure shown in FIG. 5 will be described.

Figure 6A:
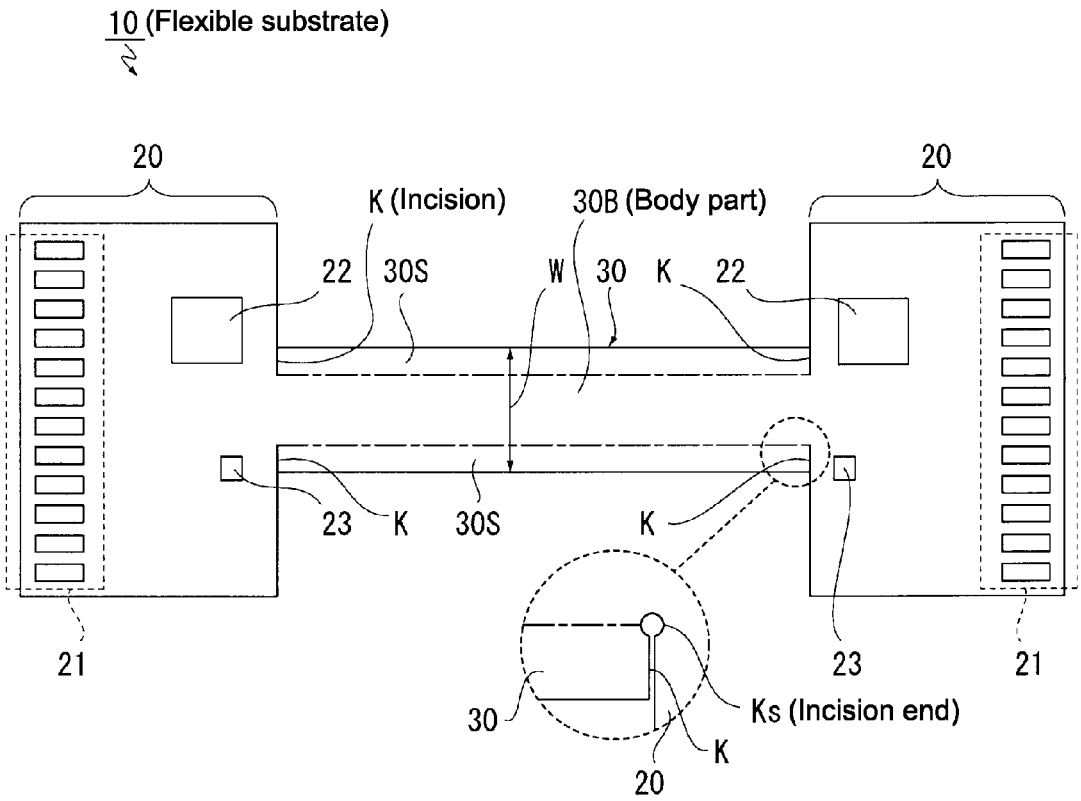
FIG. 6A is a schematic top view of a flexible substrate including connector side substrates and a cable side substrate.
Figure 6B:
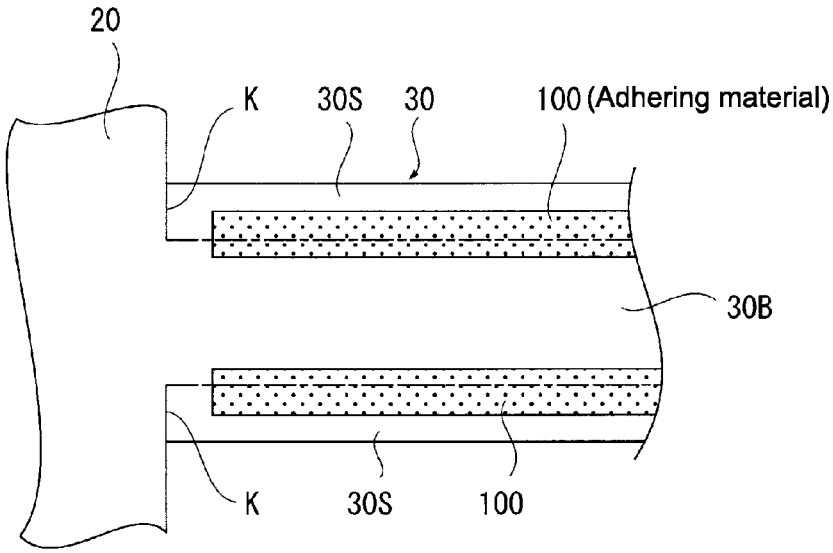
FIG. 6B is an enlarged view showing an interface between the connector side substrate and the cable side substrate.

FIG. 6A is a schematic top view of the flexible substrate 10 including the connector side substrates 20 and the cable side substrate 30. FIG. 6B is an enlarged view showing an interface between the connector side substrate 20 and the cable side substrate 30.

In order to provide the shield structure shown in FIG. 5, two incisions K, K are formed in parallel with a width direction of the cable side substrate 30 at the interface between the connector side substrates 20 and the cable side substrate 30. The two incisions K, K are formed from one side end to inside of the cable side substrate 30.

As the flexible substrate 10 includes two connector side substrates 20, 20, four incisions K are formed in total.

As shown in FIG. 6A, an incision end Ks is formed at each tip of each incision K. The incision end Ks is formed by enlarging an incision width in a predetermined shape such as a circle, for example.

By forming the incision end Ks, it is prevented that a length of each incision K unnecessarily prolongs due to a stress of folding as described later.

By forming the above-described four incisions K, K, K, K, the both sides of the cable side substrate 30 can be folded. The both sides of the cable side substrate 30 bendable are denoted as 30S, 30S. A body part of the cable side substrate 30 excluding the sides 30S, 30S is denoted as 30B.

In other words, the body part 30B is a part including the signal line 30D.

In order to provide the shield structure shown in FIG. 5, a length k of each incision K is defined by the equation k=W/4 (where W is a width of the case side substrate 30) in this embodiment.

As described above, after the flexible substrate 10 including the incisions K, K, K, K is prepared, an adhering material 100 is applied to the flexible substrate 10, as shown in FIG. 6B.

In this embodiment, a thermosetting resin is used as the adhering material 100, and is applied using a dispenser. For example, the adhering material 100 is applied to the interfaces between the sides 30S, 30S and the body part 30B.

The flexible substrate 10 to which the adhering material 100 is applied is set to a folding machine, and the sides 30S, 30S are sequentially folded.

Figure 7A:
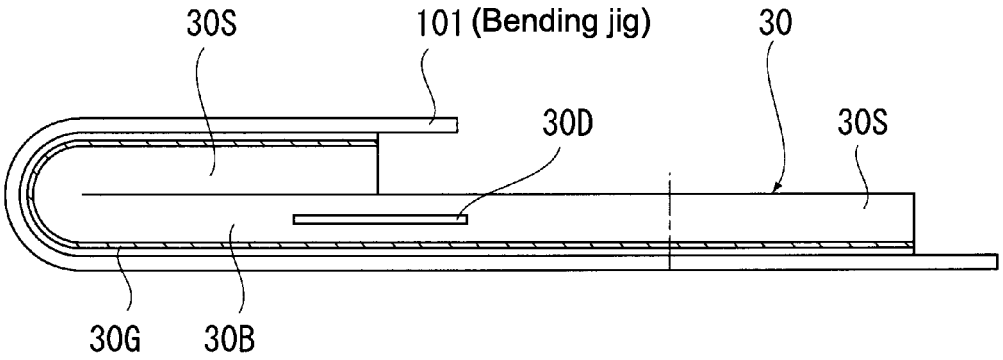
FIGS. 7A and 7B are each a schematic view showing a folded status of a substrate using a folding machine.
Figure 7B:
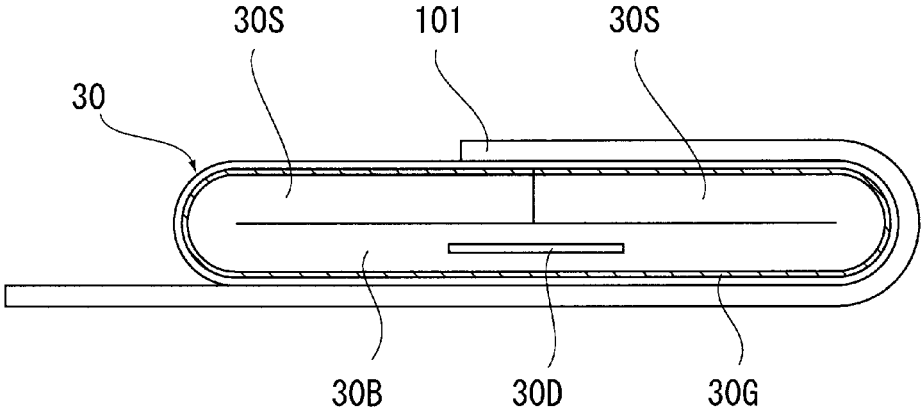

FIGS. 7A and 7B are each a schematic view showing a folded status of the sides 30S using the folding machine. Firstly, one of the sides 30S is folded. Folding is carried out using a bending jig 101 included in the folding machine, as shown in FIGS. 7A and 7B.

Next, the flexible substrate 10 is set to the folding machine in a direction opposite to that shown in FIG. 7A. As shown in FIG. 7B, the other side 30S is folded using the bending jig 101.

The flexible substrate 10 including the both sides 30S folded is put into a furnace, and is heated for a predetermined time at a predetermined temperature. In this way, the thermosetting resin used as the adhering material 100 is cured to maintain the folded status of the sides 30S, 30S.

Thus, the shield structure shown in FIG. 5, i.e., the signal line 30D is surrounded by the cable side ground layer 30G.

In this embodiment, the structure is selected by taking foldability of the cable side ground layer 30G into account. Specifically, as shown in FIG. 8A, there are formed a plurality of slits S from each side end to each inner side at the both sides of the cable side ground layer 30G.

Figure 8A:
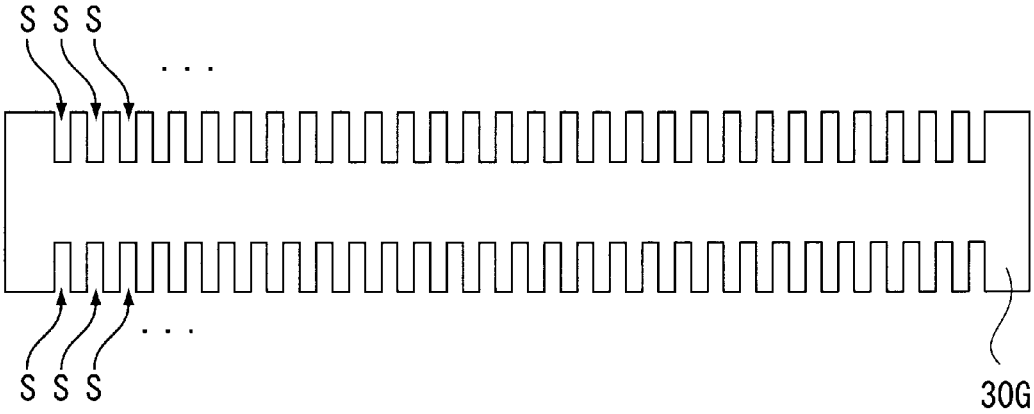
FIGS. 8A and 8B are each a configuration example of a cable side ground layer.
Figure 8B:
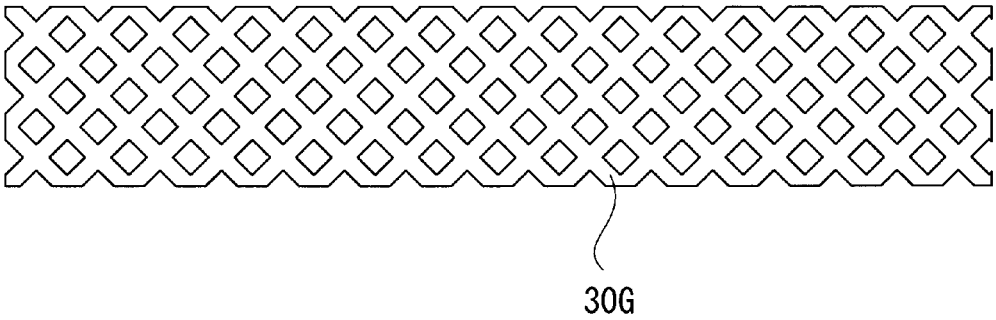

Alternatively, to improve the foldability, the cable side ground layer 30G may have a mesh structure, as shown in FIG. 8B.

The structure of the cable side ground layer 30G is not limited to those shown in FIGS. 8A and 8B. To improve the foldability, the cable side ground layer 30G may be formed to have a shape including a plurality of cutouts. In this way, bending stiffness of the cable side ground layer 30G is reduced, which results in easier folding.

1-3. Summary of First Embodiment

As described above, according to the first embodiment, in the transmission cable 3 where a transmission signal having a frequency higher than that of the data signal is transmitted, the signal line 30D is surrounded by the cable side ground layer 30G as a part including the cable side ground layer 30G of the cable side substrate 30 is folded.

In this way, the signal line 30D of the transmission cable component 3 is shielded, thereby inhibiting the EMI. As a result of an experiment, a measured value of the EMI was 0.1 mV/m.

According to this embodiment, the signal line 30D is shielded by folding a part of the cable side substrate 30 where the cable side ground layer 30G is formed. Therefore, there is no need to add a separate member unlike the related art to which a shield film is added separately. In other words, it is enough to form the cable side substrate 30 wider than usual, and adding a separate member is unnecessary.

According to this embodiment, as the flexible substrate 10 is used, a transmission cable is soft and has an excellent flexibility.

In terms of these points, according to this embodiment, the structure used for the signal transmission can be provided at low costs while the EMI is inhibited and a degree of freedom for mounting is ensured.

According to this embodiment, as the signal line 30D is surrounded by the cable side ground layer 30G, the cable side ground layer 30G is disposed at lower, upper and lateral sides of the signal line 30D.

Thus, there is provided a high shielding effectiveness and the EMI can be inhibited effectively.

According to this embodiment, the cable side ground layer 30G has a shape including a plurality of cutouts.

In this way, bending stiffness of the cable side ground layer 30G is reduced, which results in easier folding. Thus, the shield structure can be easily produced. Accordingly, a production efficiency of the transmission module 1 can be improved.

Further, according to this embodiment, the connector side substrate 20 and the cable side substrate 30 are configured as the integrated flexible substrate 10 made of the same material.

In this way, the transmission module 1 including the connector component 2 and the transmission cable component 3 are produced using the integrated flexible substrate 10. Using the integrated substrate, the transmission module 1 can be efficiently produced.

In addition, according to this embodiment, the carrier wave of the signal transmitted via the transmission cable component 3 is the millimeter wave.

This enables that electromagnetic noises generated upon a transmission of a high frequency signal within a millimeter wave band are shielded. In other words, the EMI can be inhibited when the high frequency signal within the millimeter wave band is processed.

Also, according to this embodiment, the cable side substrate 30 and the connector side substrate 20 are configured of the LCP.

In this way, the cable side substrate 30 and the connector side substrate 20 are configured of the material that efficiently suppresses noises, thereby further inhibiting the EMI.

2. Second Embodiment

2-1. Configuration of Transmission Module and Production Method

Then, a transmission module 1' according to a second embodiment will be described.

In the following description, the same components already described in the first embodiment are denoted by the same reference numerals, and thus detailed description thereof will be hereinafter omitted.

An appearance of the transmission module 1' according to the second embodiment is the same as that of the transmission module 1, and is therefore omitted.

Figure 9:
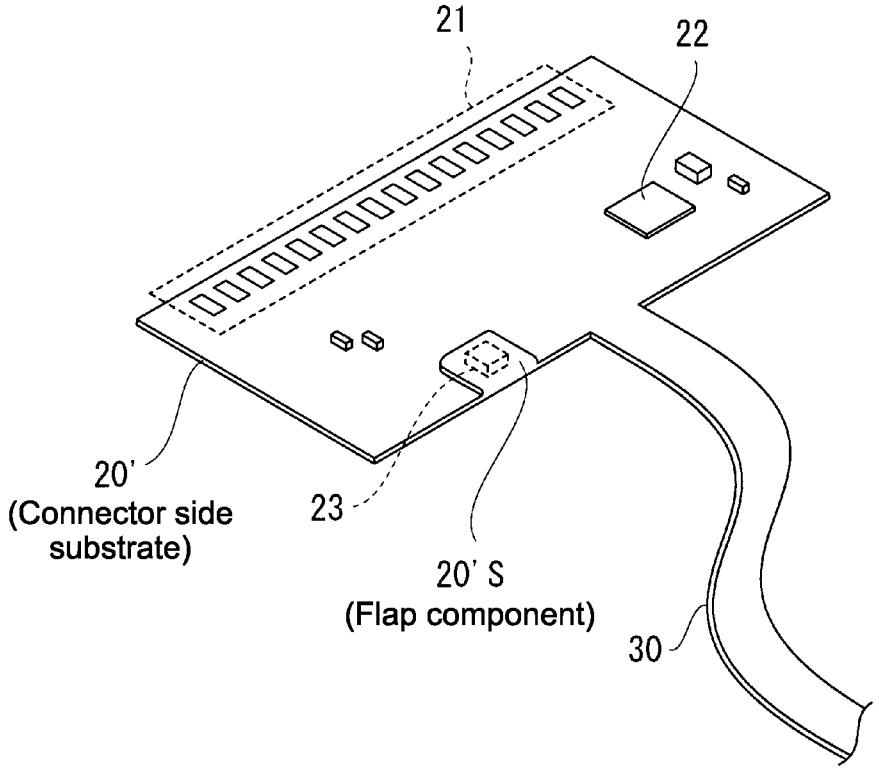
FIG. 9 is a schematic perspective view showing a configuration of a connector side substrate and a cable side substrate included in a transmission module according to a second embodiment.

FIG. 9 is a schematic perspective view showing a configuration of a connector side substrate 20' and the cable side substrate 30 included in the transmission module 1'.

As shown in FIG. 9, in the transmission module 1', a flap component 20'S formed as a part of the connector side substrate 20' is folded. Accordingly, the RF chip 23 is surrounded by a part of the connector side substrate 20'.

Figure 10A:
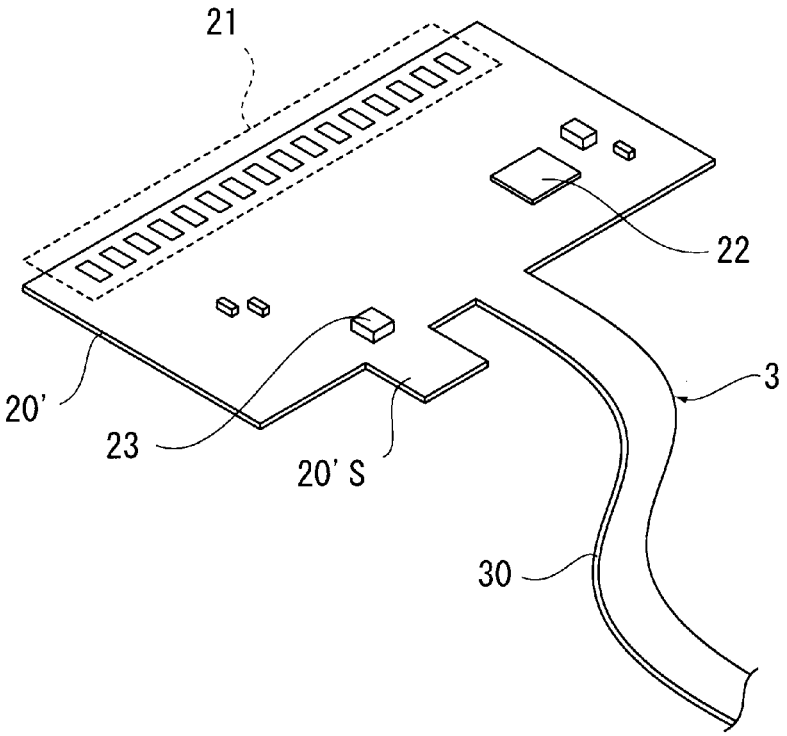
FIGS. 10A and 10B are each an illustration of a shield structure according to a second embodiment.

As shown in a schematic perspective view of FIG. 10A, the flap component 20'S is formed such that a part of a side of the connector substrate 20' is protruded externally. When the flap component 20'S is folded in this way, the RF chip 23 is covered with the flap component 20'S as a part of the connector side substrate 20'.

Figure 10B:
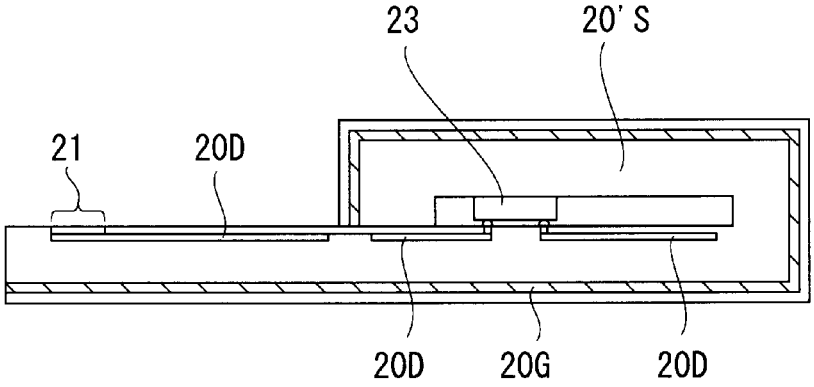

As shown in a schematic perspective view of FIG. 10B, the connector side ground layer 20G is also formed on the flap component 20'S. Accordingly, the RF chip 23 covered with the flap component 20'S as described above is surrounded by the connector side ground layer 20G. In other words, the connector side ground layer 20G is disposed at lower, upper and lateral sides of the RF chip 23. As appreciated from the above description, the electromagnetic noises are generated at the RF chip 23 due to the high frequency signal. Therefore, by surrounding the RF chip 23 by the connector side ground layer 20G, the EMI can be inhibited.

Figure 11A:
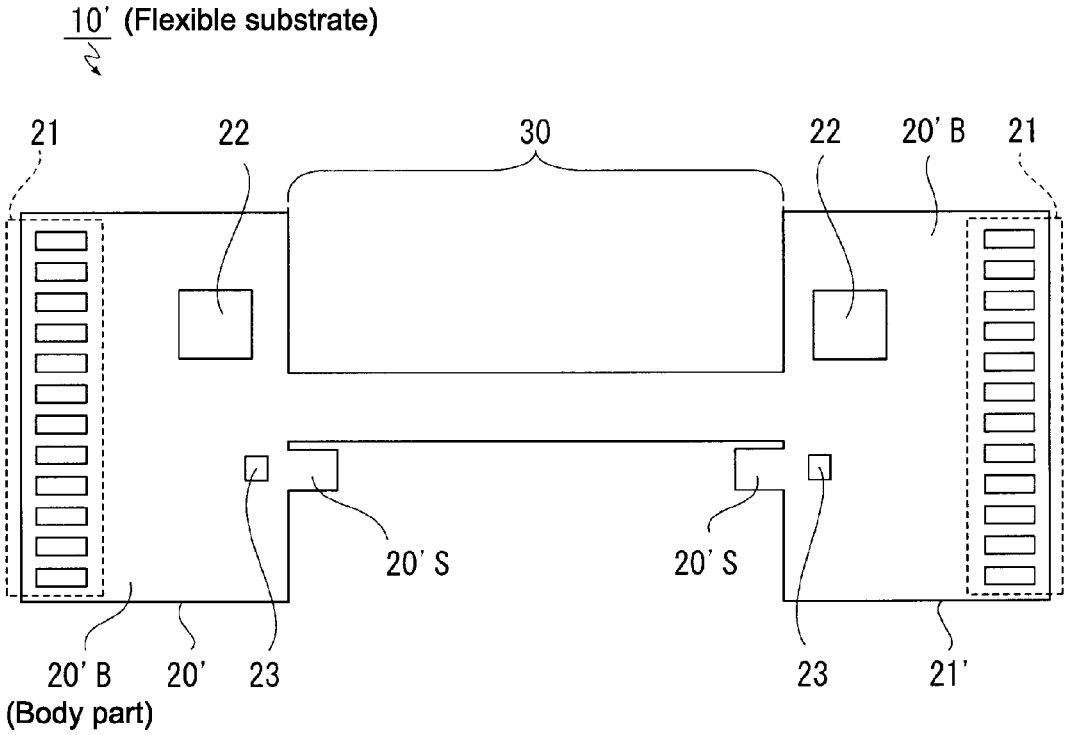
FIGS. 11A and 11B are each an illustration of a method of producing the shield structure according to the second embodiment.
Figure 11B:
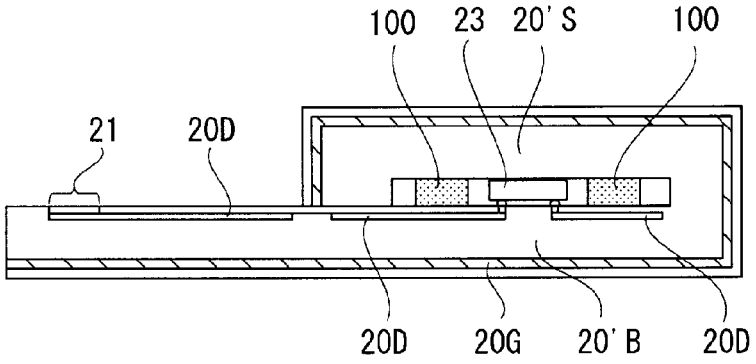

FIGS. 11A and 11B are each an illustration of a method of producing the shield structure according to the second embodiment. FIG. 11A is a schematic top view of a flexible substrate 10' where the connector side substrate 20' and the cable side substrate 30 are integrally formed. FIG. 11B is a schematic longitudinal sectional view of the connector side substrate 20' where the flap component 20'S is folded.

In order to provide the shield structure shown in FIG. 10B, there is provided the flexible substrate 10' where the connector side substrate 20' having the flap component 20'S as shown in FIG. 11A is formed.

An area excluding the flap component 20'S in the connector side substrate 20' is denoted as a body part 20'B shown.

Upon folding, at least any of the body part 20'B and the flap component 20'S of the connector side substrate 20' is firstly coated with the adhering material 100 (not shown). The adhering material 100 is coated such that the flap component 20'S can cover the RF chip 23 when the flap component 20'S is folded (see FIG. 11B).

Also in this embodiment, a thermosetting resin is used as the adhering material 100, for example.

After the adhering material 100 is coated, the flap component 20'S is folded using the folding machine as in the first embodiment. The flexible substrate 10' having the folded flap component 20'S is put into a furnace, and is heated for a predetermined time at a predetermined temperature. In this way, the thermosetting resin used as the adhering material 100 is cured to maintain the folded status of the flap component 20'S.

In addition, the flap component 20'S can be heated for fixing while the sides 30S, 30S of the transmission cable component 3 are heated for fixing simultaneously (at the same time).

2-2. Summary of Second Embodiment

As described above, according to the second embodiment, the area where the electromagnetic noises are generated due to the high frequency signal is surrounded by the connector side ground layer 20G as a part including the connector side ground substrate 20' is folded.

This enables that electromagnetic noises caused by the high frequency signal are shielded not only at the transmission cable component 3 but also at the connector component 2, whereby the EMI can be further inhibited over the transmission module 1' as a whole.

Also in the second embodiment, the RF chip 23 (a signal processing component) is surrounded by the connector side ground layer 20G.

This enables that electromagnetic noises generated in the RF chip 23 are shielded. In particular, as the high frequency signal including the millimeter wave is generated at the RF chip 23 in the connector component 2 that is a receiving side, it is effective to shield the RF chip 23 for inhibiting the EMI.

3. Alternative Embodiment

While the embodiments of the present application are described hereinabove, it should be understood that the present application is not limited to the above-described illustrative embodiments, and a number of variations and modifications may be made.

Specifically, in the above-describe embodiment, the shield structure is provided by folding the sides 30S, 30S on the both sides of the cable side substrate 30. In this case, the equation k=W/4 is held, i.e., tips of the folded sides 30S, 30S are in contact (see FIG. 5). However, the way to form the two sides 30S, 30S is not limited thereto. At least one of the sides 30S may be longer than that in the first embodiment, and the other side 30S (firstly folded) is put on the one side 30S (secondly folded).

In this case, it is desirable that the adhering material 100 be coated so that the other side 30S put on can be adhered.

Figure 12:
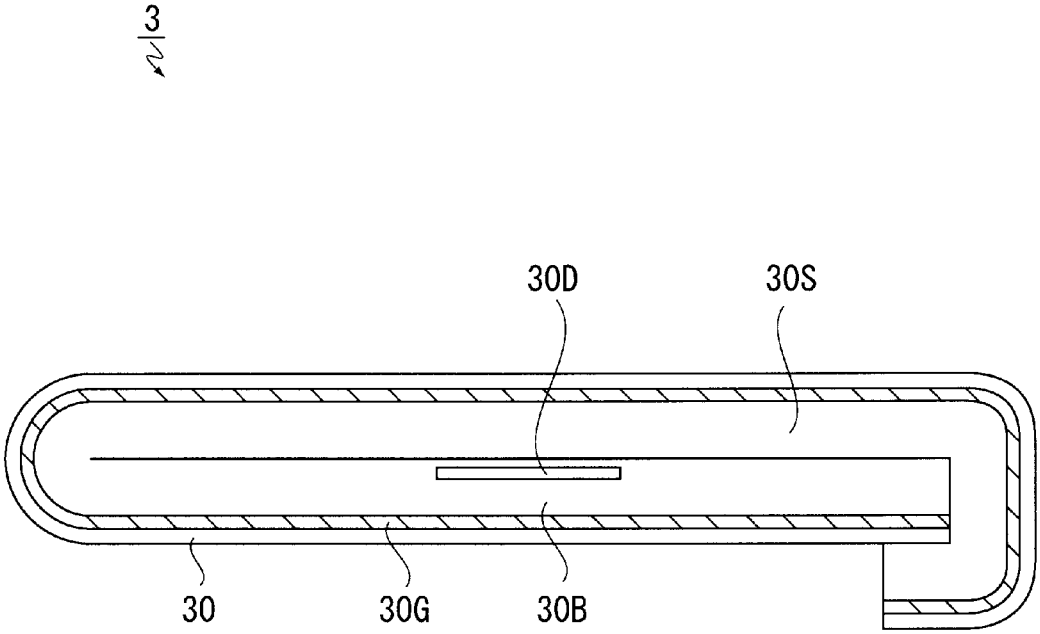
FIG. 12 is an illustration of an alternative embodiment of the shield structure in the transmission cable component.

Also, it is not limited to the case that the two sides 30S, 30S are folded. For example, as shown in FIG. 12, only one side 30S having a width exceeding two times of the body part 30B is formed and folded, whereby the signal line 30D may be surrounded by the cable side ground layer 30G.

Figure 13A:
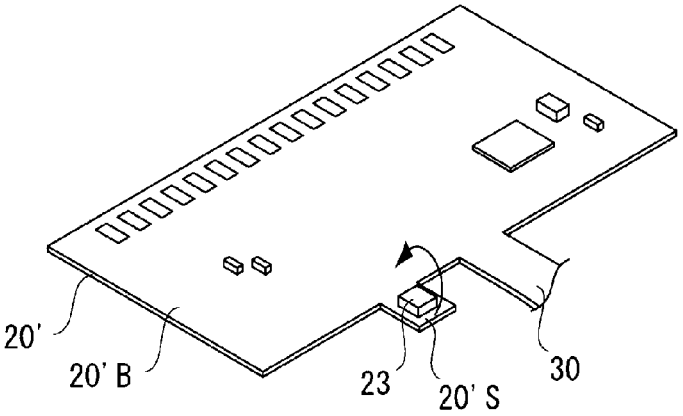
FIGS. 13A, 13B and 13C are each an illustration of an alternative embodiment of the shield structure in a connector component.

In addition, in the second embodiment, the flap component 20'S is folded to cover the RF chip 23 formed on the body part 20'B. Alternatively, the RF chip 23 may be formed on the flap component 20'S as shown in FIG. 13A and the flap component 20'S may be folded over the body part 20'B to cover the RF chip 23 by a part of the cable side substrate 20'. In this way, the RF chip 23 can be surrounded by the cable side ground layer 20G.

Figure 13B:
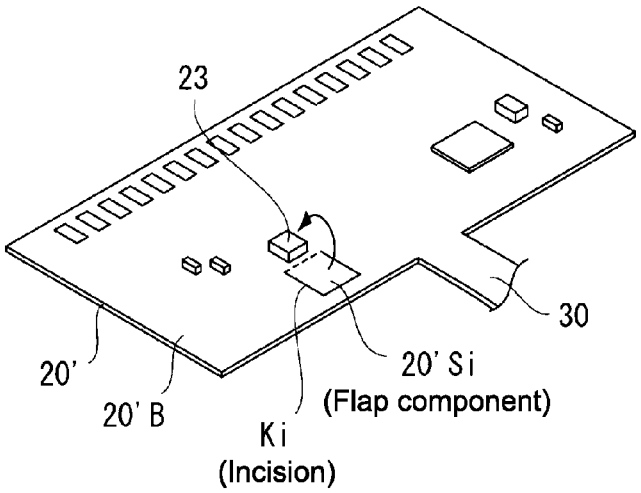

Furthermore, it is not limited to fold the flap component 20'S protruded externally from the body part 20'B. Alternatively, as shown in FIG. 13B, a substantially angular U-shaped incision Ki may be formed inside from an outer edge of the body part 20'B to form a flap component 20'Si. The flap component 20'Si may be folded to cover the RF chip 23.

Figure 13C:
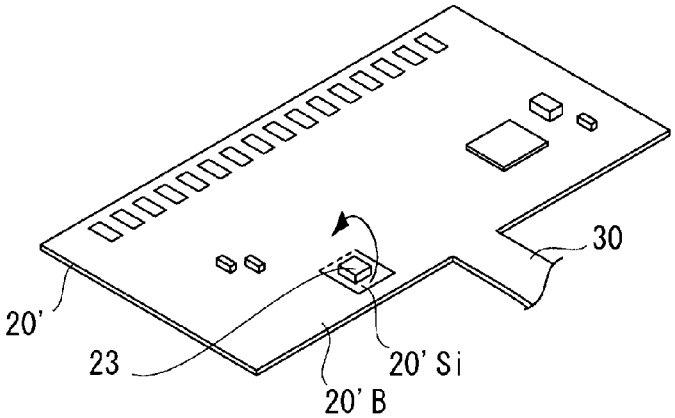

As shown in FIG. 13C, the RF chip 23 is formed on the flap component 20'Si, and the flap component 20'Si is folded to the body part 20'B to surround the RF chip 23 by a part of the cable side substrate 20'.

So far, in order to suppress the electromagnetic noises due to the high frequency signal, the ground layer is disposed around the noise source (lower, upper and lateral sides). According to the present application, the ground layer may be disposed at least at the upper and lower sides of the noise source.

Figure 14A:
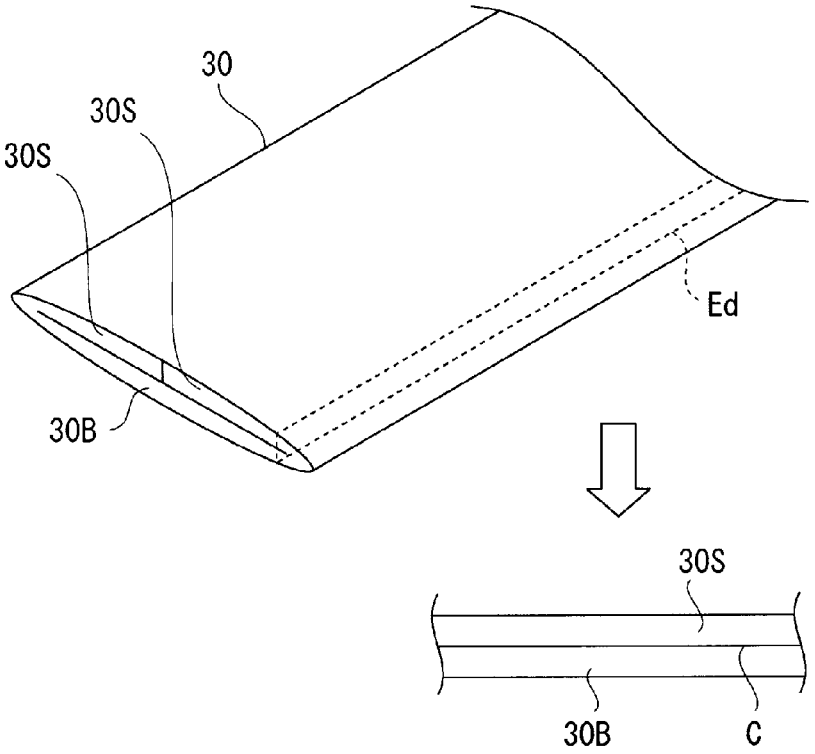
FIGS. 14A and 14B are each an illustration of an alternative embodiment where a ground layer is disposed only at upper and lower sides of a noise source.

For example, as shown in an upper perspective view of FIG. 14A, in the cable side substrate 30 including the folded sides 30S, a lateral end of the cable side substrate 30 enclosed by a dashed line Ed (i.e., a turned back part in a substantially U shape of the side 30S) may be cut in a longitudinal direction such that the side 30S is cut off from the body part 30B, as shown in an enlarged lower side view of FIG. 14A. In the enlarged lower side view, a solid line C represents a border between the side 30S and the body part 30B. In this situation, the cable side ground layer 30G is only disposed at the lower and upper of the signal line 30D as the noise source. With this, a certain shielding effectiveness can be provided. In other words, although it may have a reduced effectiveness as compared to the case that the signal line is entirely surrounded as illustrated above, a certain EMI inhibition effectiveness can be provided.

Figure 14B:
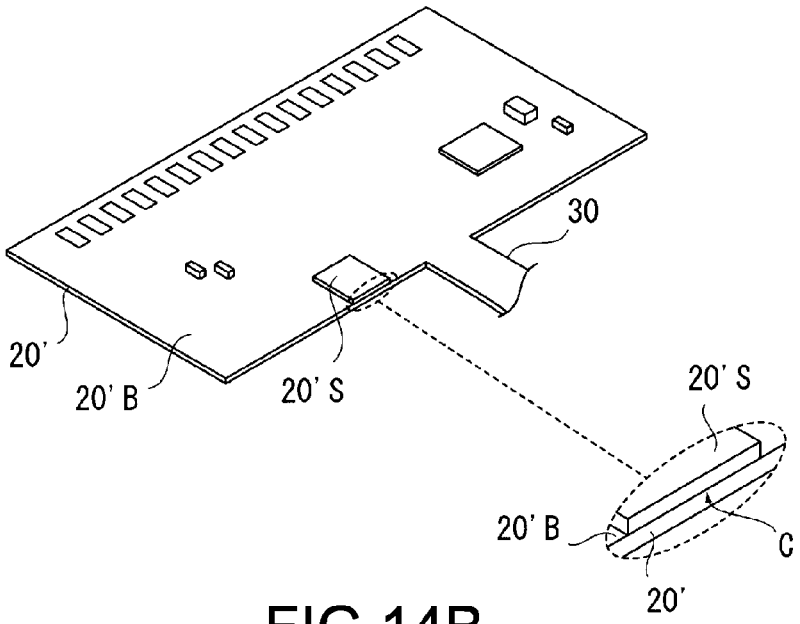

The same applies to the shield structure at the connector component 2 side. In other words, as shown in the perspective view of FIG. 14B, in the connector side substrate 20' including the folded flap component 20'S, a turned back part of the flap component 20'S may be cut in a longitudinal direction such that the body part 20'B is separated from the flap component 20'S (in an enlarged view of FIG. 14B, a solid line C represents a border between the body part 20'B and the flap component 20'S). With this, although it may have a reduced effectiveness as compared to the case that the RF chip 23 is entirely surrounded according to the second embodiment, a certain EMI inhibition effectiveness can be provided.

As described above, even if the turned back part is cut after the side 30S and the flap component 20'S are folded, the ground layer is eventually disposed at the lower and upper sides of the noise source in response to folding.

As appreciated from this, according to the present application, the ground layer may be disposed at the upper and lower sides of the noise source as a part of the ground layer (the cable side ground layer 30G or the connector side ground layer 20G) in the substrate (the cable side substrate 30 or the connector side substrate 20') is folded, thereby advantageously inhibiting the EMI.

Figure 15A:
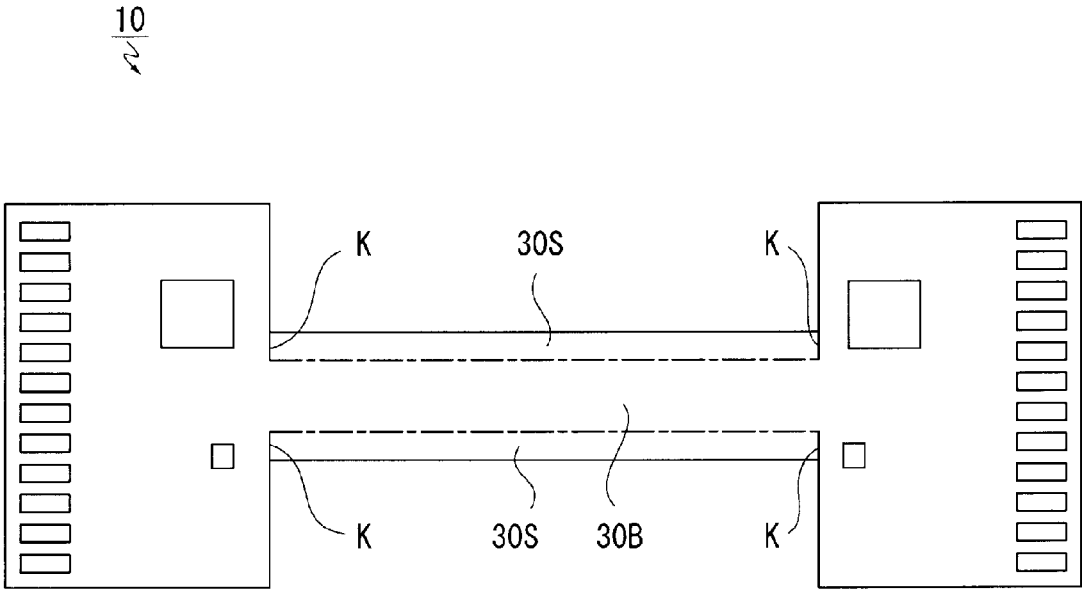
FIGS. 15A and 15B are each an illustration of a shield structure where sides of the cable side substrate is folded.
Figure 15B:
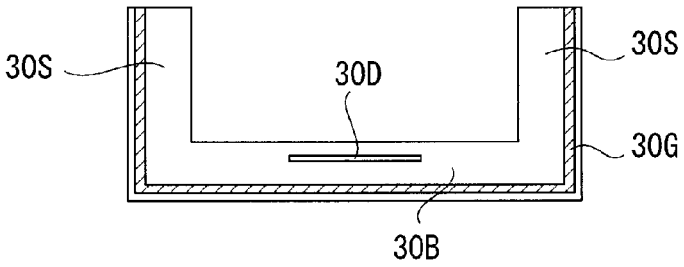

In terms of the EMI inhibition effectiveness, the sides 30S are not necessarily folded. FIG. 15A shows the flexible substrate 10 having the sides 30S, 30S. It is contemplated that the sides 30S, 30S of the flexible substrate 10 are folded by at a predetermined angle (for example, at 90 degrees) such that the cable side ground layer 30G is disposed only at the lower and both lateral sides of the signal line 30D, as shown in the cross-sectional view of FIG. 15B. This may also provide the EMI inhibition effectiveness.

In the second embodiment, an objective to be shielded in the connector component 2 is the RF chip 23. Other than the RF chip 23, the shield structure according to the present application can be applied to other noise sources such as an RF line (a signal line for inputting/outputting to/from the RF chip 23) and a coupler.

All layers of the substrate are not necessarily folded, but only a layer including the ground layer may be folded.

So far, the thermosetting resin is used as the adhering material 100. Alternatively, other setting resin such as a two-part setting resin may be used. It is also possible to use metal molecules engaged and bonded by metal compression other than resin. As the adhering material 100 by the metal compression, copper or gold may be used.

Also, the cable side substrate 30 and the connector side substrate 20 (20') may be configured separately.

4. Present Application

The present application may have the following configurations.

(1) A transmission module, including:

a connector component including a connector side substrate having a terminal component including a ground terminal and a data terminal, and a signal processing component mounted on the connector side substrate for processing a high frequency signal having a frequency higher than that of a data signal inputted or outputted via the data terminal; and a transmission cable component for transmitting the high frequency signal including a cable side substrate having a flexibility on which a cable side ground layer electrically connected to the ground terminal and a signal line to which the high frequency signal is transmitted are formed, the cable side ground layer being disposed at least at lower and upper sides of the signal line as a part including the cable side ground layer of the cable side substrate is folded.

(2) The transmission module according to (1) above, in which the cable side ground layer is disposed at lower, upper and lateral sides of the signal line.

(3) The transmission module according to (1) or (2) above, in which the cable side ground layer has a shape including a plurality of cutouts.

(4) The transmission module according to any of (1) to (3) above, in which the connector side substrate and the cable side substrate are configured as an integrated substrate made of a same material.

(5) The transmission module according to (4) above, in which a connector side ground layer electrically connected to the ground terminal is formed on the connector side substrate, and the connector side ground layer is disposed at least at lower and upper sides of an area where electromagnetic noises are generated due to the high frequency signal as a part including the connector side ground layer of the connector side substrate is folded.

(6) The transmission module according to (5) above, in which the signal processing component is an RF chip, and the connector side ground layer is disposed at least at lower and upper sides of the RF chip as a part including the connector side ground layer of the connector side substrate is folded.

(7) The transmission module according to any of (1) to (6) above, in which a carrier wave of a signal transmitted via the transmission cable is a millimeter wave.

(8) The transmission module according to any of (1) to (7) above, in which the cable side substrate or the connector side substrate is configured of LCP.

(9) A method of shielding a signal line in the transmission module including a connector component including a connector side substrate having a terminal component including a ground terminal and a data terminal, and a signal processing component mounted on the connector side substrate for processing a high frequency signal having a frequency higher than that of a data signal inputted or outputted via the data terminal; and a transmission cable component for transmitting the high frequency signal including a cable side substrate having a flexibility on which a cable side ground layer electrically connected to the ground terminal and the signal line to which the high frequency signal is transmitted are formed, including:

folding a part including the cable side ground layer of the cable side substrate, and disposing the cable side ground layer at least at lower and upper sides of the signal line.

(10) A transmission cable, including a substrate having a flexibility on which a ground layer and a signal line are formed, the ground layer being disposed at least at lower and upper sides of the signal line as a part including the ground layer of the substrate is folded.

(11) A connector, including:

a substrate having a flexibility on which a terminal component including a ground terminal and a data terminal, and a ground layer electrically connected to the ground terminal are formed; and a signal processing component mounted on the substrate for processing a high frequency signal having a frequency higher than that of a data signal inputted or outputted via the data terminal, the ground layer being disposed at least at lower and upper sides of an area where electromagnetic noises are generated due to the high frequency signal as a part including the ground layer of the substrate is folded.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A transmission module, comprising:

a connector component including a connector side substrate having a terminal component including a ground terminal and a data terminal, and a signal processing component mounted on the connector side substrate for processing a high frequency signal having a frequency higher than that of a data signal inputted or outputted via the data terminal; and a transmission cable component for transmitting the high frequency signal including a cable side substrate having a flexibility on which a cable side ground layer electrically connected to the ground terminal and a signal line to which the high frequency signal is transmitted are formed, wherein the cable side ground layer being disposed at least at lower and upper sides of the signal line as a part including the cable side ground layer of the cable side substrate is folded, wherein the connector side substrate and the cable side substrate are configured as an integrated substrate made of a same material, wherein a connector side ground layer electrically connected to the ground terminal is formed on the connector side substrate, and wherein the connector side ground layer is disposed at least at lower and upper sides of an area where electromagnetic noises are generated due to the high frequency signal as a part including the connector side ground layer of the connector side substrate is folded.

2. The transmission module according to claim 1, wherein the cable side ground layer is disposed at lower, upper and lateral sides of the signal line.

3. The transmission module according to claim 1, wherein the cable side ground layer has a shape including a plurality of cutouts.

4. The transmission module according to claim 1, wherein the signal processing component is an RF chip, and the connector side ground layer is disposed at least at lower and upper sides of the RF chip as a part including the connector side ground layer of the connector side substrate is folded.

5. The transmission module according to claim 1, wherein a carrier wave of a signal transmitted via the transmission cable is a millimeter wave.

6. The transmission module according to claim 1, wherein the cable side substrate or the connector side substrate is configured of LCP.

7. A method of shielding a signal line in the transmission module including a connector component including a connector side substrate having a terminal component including a ground terminal and a data terminal, and a signal processing component mounted on the connector side substrate for processing a high frequency signal having a frequency higher than that of a data signal inputted or outputted via the data terminal; and a transmission cable component for transmitting the high frequency signal including a cable side substrate having a flexibility on which a cable side ground layer electrically connected to the ground terminal and the signal line to which the high frequency signal is transmitted are formed, comprising:

folding a part including the cable side ground layer of the cable side substrate, and disposing the cable side ground layer at least at lower and upper sides of the signal line, wherein the connector side substrate and the cable side substrate are configured as an integrated substrate made of a same material, wherein a connector side ground layer electrically connected to the ground terminal is formed on the connector side substrate, and wherein the connector side ground layer is disposed at least at lower and upper sides of an area where electromagnetic noises are generated due to the high frequency signal as a part including the connector side ground layer of the connector side substrate is folded.

8. A transmission cable connected to a connector, comprising a cable side substrate having a flexibility on which a cable side ground layer and a signal line are formed, the cable side ground layer being disposed at least at lower and upper sides of the signal line as a part including the cable side ground layer of the cable side substrate is folded, wherein the connector includes a substrate having a flexibility on which a terminal component including a ground terminal and a data terminal, and a ground layer electrically connected to the ground terminal are formed; and a signal processing component mounted on the substrate for processing a high frequency signal having a frequency higher than that of a data signal inputted or outputted via the data terminal, wherein the ground layer is disposed at least at lower and upper sides of an area where electromagnetic noises are generated due to the high frequency signal as a part including the ground layer of the substrate is folded.

9. A connector, comprising:

a substrate having a flexibility on which a terminal component including a ground terminal and a data terminal, and a ground layer electrically connected to the ground terminal are formed; and a signal processing component mounted on the substrate for processing a high frequency signal having a frequency higher than that of a data signal inputted or outputted via the data terminal, the ground layer being disposed at least at lower and upper sides of an area where electromagnetic noises are generated due to the high frequency signal as a part including the ground layer of the substrate is folded.

10. The connector according to claim 9, wherein the signal processing component includes an RF chip.

11. The connector according to claim 10, wherein the ground layer is disposed at least at lower and upper sides of the RF chip as a part including the connector side ground layer of the connector side substrate is folded.

12. The connector according to claim 9, wherein the substrate includes LCP.

13. The transmission cable according to claim 8, wherein the cable side ground layer has a shape including a plurality of cutouts.

14. The transmission cable according to claim 8, the cable side substrate includes LCP.

15. The transmission cable according to claim 8, the cable side substrate and the substrate of the connector are configured as an integrated substrate made of a same material.

* * * * *